United States Patent [19]

Webb et al.

[11] 4,379,552

[45] Apr. 12, 1983

[54] EXERCISING DEVICE

[75] Inventors: Ronald W. Webb; Robert L. Morgan, both of Spokane, Wash.

[73] Assignee: Rotator, Ltd., Spokane, Wash.

[21] Appl. No.: 273,053

[22] Filed: Jun. 12, 1981

[51] Int. Cl.[3] ..... A63B 21/00

[52] U.S. Cl. ..... 272/67; 272/132

[58] Field of Search ..... 272/67, 68, 132, 130, 272/137, 140

[56] References Cited

U.S. PATENT DOCUMENTS

| | | | |
|---|---|---|---|
| 799,270 | 9/1905 | Roland | 272/141 |
| 1,604,333 | 10/1926 | Anderson | 272/132 |
| 3,649,008 | 3/1972 | Zinken | 272/67 |
| 3,811,672 | 5/1974 | Simmons | 272/132 |
| 4,203,591 | 5/1980 | Gibson | 272/132 |

*Primary Examiner*—Richard J. Johnson

*Attorney, Agent, or Firm*—Wells, St. John & Roberts

[57] ABSTRACT

An exercising device is described for developing strength and endurance in the wrist and forearms. The device includes two handles mounted to a housing. One handle is fixed. The other handle is rotatable about the axis of a shaft mounting it to the housing. Variable resistance to rotation of the handle and shaft is provided through a dial adjustable brake arrangement attached to the shaft within the housing. The shaft-mounted handle is angularly offset from the shaft axis by an obtuse angle that best represents the natural angular wrist-forearm relation used during pronation, supination, flexion, extension, abduction, and adduction of the wrist. Specific groups of arm and wrist muscles can thus be exercised isotonically by holding one handle stationary and repeatedly turning the other handle against the resistance selected.

8 Claims, 7 Drawing Figures

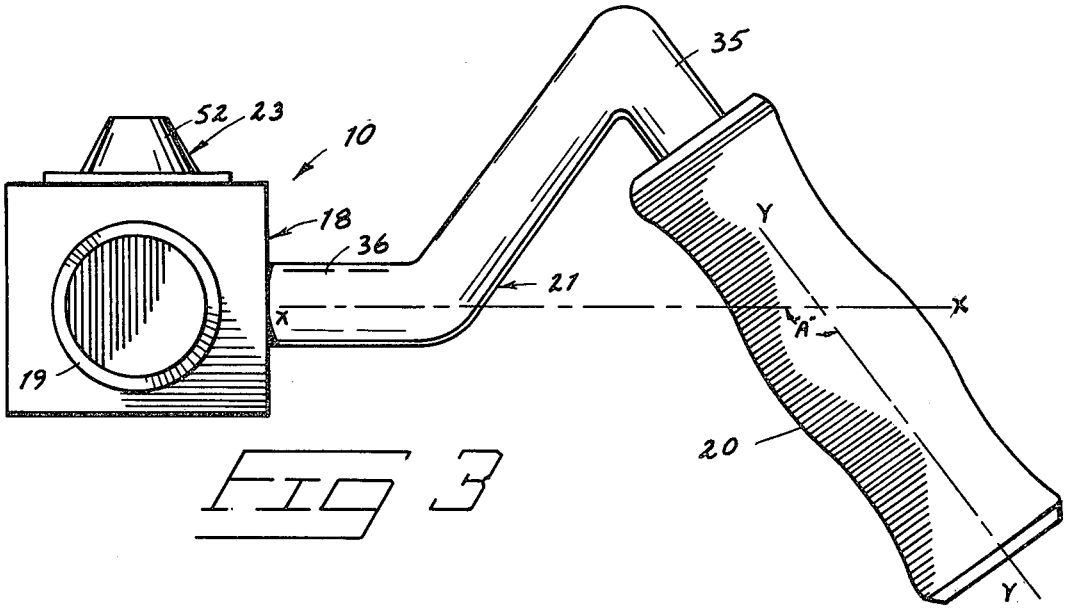
FIG 3
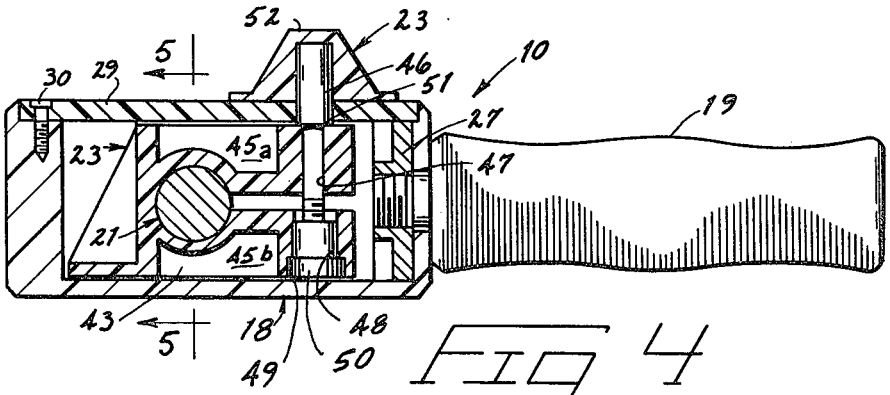
FIG 4
FIG 5
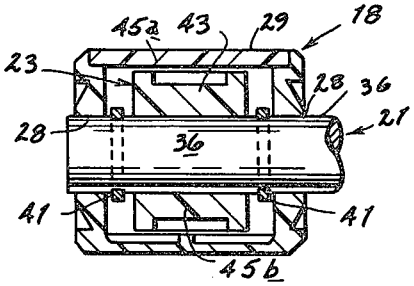

EXERCISING DEVICE

BACKGROUND OF THE INVENTION

The present invention is related to muscle exercising devices and more particularly to such devices that are used to isotonically exercise the wrist and arms.

There is a considerable inadequency in the field of isotonic exercise devices for developing wrist and arm strength and endurance. Conventional wrist "curl" exercises utilizing weights have only limited effectiveness primarily due to inflexibility of the exercise device and lack of proper anatomic design. Existing equipment used for developing muscles in the wrist and arms typically function to develop muscles in a different manner than when the muscles are used in the execution of a movement in a sport or activity. In short, existing devices do not have the capability to train and develop muscles in the region of the wrist and forearms for optimum benefit in selected sports and activities.

Sports activities involving the use of a hand held club, racquet, bat or similar device demand strong wrist and forearm muscles. Examples of such sports are golf, baseball, hockey, racquet sports, Jaialai, polo, horseshoes, cricket, etc. Properly exercised and developed wrist and forearm muscles add to swing power and control. Additional benefits from proper exercise are also realized in throwing activities associated with baseball, bowling, volleyball, basketball, javelin, shot put, etc. Skill in other activities such as canoeing, pistol shooting, fly and spin fishing, wood chopping, archery, fencing, etc. may also be greatly improved by proper wrist and forearm exercise.

Most present wrist and forearm exercise involves either lifting weights via a rotatable hand grip device or operating a hand grip against selected frictional resistance. The weighted apparatus are usually wall or frame mounted and include a dowel shaped handle to be rotated about a fixed axis in order to lift the weight. Devices that employ frictional resistance to turning forces have the same basic handle design as the weighted varieties.

The basic problem with the above apparatus is inflexibility of the turning handle(s). The resistance is offered along the axis of the hand grip and the turning forces applied must be substantially perpendicular to the turning axis. Such a relationship does not permit proper exercise of the primary muscles involved in abduction and adduction of the wrist joint. It also makes exercise of the proper pronator and supinator muscle groups difficult, since the wrist must be adducted beyond the natural, optimum wrist-forearm angle in order to accomplish the exercise. The resulting motion is therefore not a product of natural muscle function.

The present device makes use of a pair of angularly disposed handles joined to a hollow housing. One handle is fixed along its axis to the housing while the other rotates about an angularly disposed axis. Further, the second handle is itself angularly disposed from its turning axis. The angle of the handle to its axis is selected to be the optimum angle at which the muscles involved in all wrist movement may best be exercised.

A primary object of the present invention is thus to provide an exercising device that may be used in various postures to effectively exercise specific groups of muscles of the arm and wrist in order to increase strength, control, and endurance of natural wrist motions.

Another object is to provide such an exerciser that is compact and can be easily stored and transported, and that can be used effectively without requiring special facilities.

Another object is to provide such an exercising device that is very simple in construction and therefore relatively maintenance free.

A still further object is to provide such an exercising device that is adjustable to offer varied resistance for selected wrist and forearm motions, so adjustments can be easily and quickly made to accommodate the various muscle groups and to change the resistance to fit any desired exercise program.

These and yet further objects and advantages may become apparent from the following description, which, taken with the accompanying drawings, describe a preferred form of the present invention.

BRIEF DESCRIPTION OF THE DRAWINGS

A preferred form of the present invention is illustrated in the accompanying drawings in which:

FIG. 3 is an enlarged side elevational view of the present invention;

FIG. 4 is an enlarged sectional view taken along a plane indicated by line 4–4 in FIG. 2;

FIG. 5 is a fragmentary sectional view taken along line 5–5 in FIG. 4;

DETAILED DESCRIPTION

The basic function of the present invention is to provide isotonic exercise for arm and wrist muscles to increase strength, control and endurance for any of many activities. For purposes of later description, a brief account of forearm and wrist motions will be given. Two basic movements of the forearm are supination, which involves rotation of the palm about the axis of the forearm from a position facing downward to a position facing upward and pronation wherein the palm is moved about the axis of the forearm from an upwardly facing position to a downwardly facing position. Wrist motions can be categorized as: flexion in which the palm is moved to face the elbow, and extension in which the back of the hand is moved or pivoted relative to the forearm to face the elbow. Adduction as involves the wrist being moved in the plane of the hand toward the thumb side and abduction involves the wrist being moved in the plane of the hand toward the little finger side. Various combinations of these motions are possible by flexing or extending appropriate muscle groups of the wrist, forearm, and the upper arm.

Figure 1:
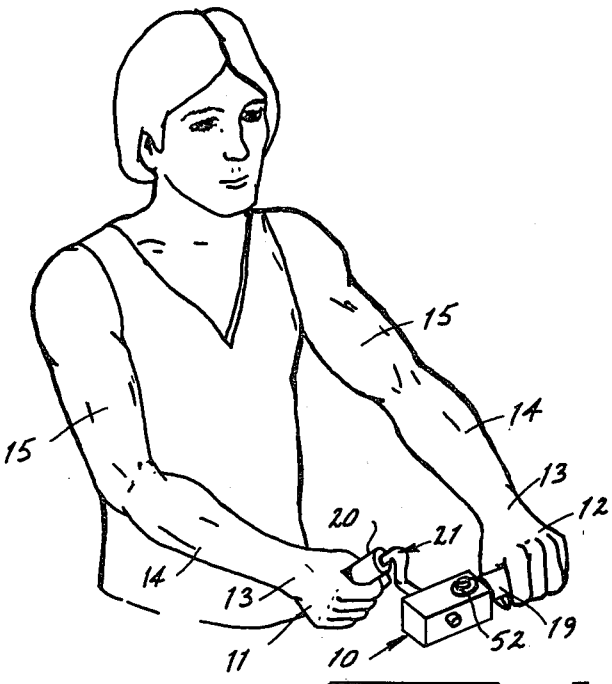
FIG. 1 is a pictorial view of the present invention in use, with the grip shown being used to exercise the pronator and supinator arm muscles.
Figure 2:
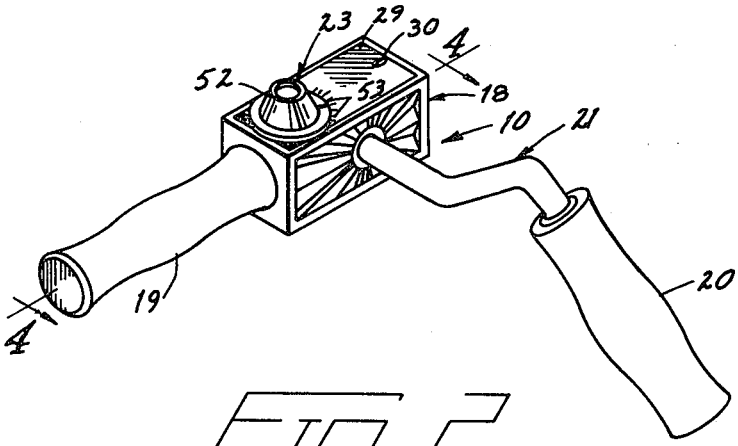
FIG. 2 is a pictorial view of the present exercise device.

The present device is generally indicated in the drawings by the reference numeral 10. The present exercising device 10 is adapted to be hand-held by the right and left hands 11, 12 for the purpose of isotonic exercise of the wrist 12, forearms 14 and, to a limited degree, the upper arms 15 (FIG. 1).

The device 10 is shown in substantial detail by FIGS. 2 through 5. The device includes a hollow housing 18 mounting a first handle 19 and an angularly oriented second handle 20. The second handle is mounted to the housing by a shaft 21. Restrictor means 23 (FIGS. 4 & 5) is situated between the shaft 21 and housing 18 in order to selectively resist rotational movement of the shaft 21 about its central turning axis (as indicated at X—X in FIG. 3).

The housing 18 is best shown by FIGS. 4 and 5. The housing 18 includes a hollow interior 26. The housing walls are preferably made of a synthetic resin material, providing a secure mount in the form of a nut 27 for the first handle 19. The handle 19 and housing 26 are thereby fixed relative to one another. The housing 18 includes aligned holes 28 for rotatably receiving the inward end of the shaft 21. The restrictor means 23 is mounted with the interior 26.

A cover 29 is releasably secured to the housing by appropriate screws 30. The cover 29 closes the hollow housing interior 26 and secures the restrictor means 23 in position, along with the walls of the housing.

The shaft 21, as shown in FIGS. 3 and 5, is mounted to the housing for rotation thereon about a second axis that is angularly oriented in relation to the first axis of the first handle 19. The second axis, as briefly indicated above, is indicated at X—X in FIG. 3. It is preferred that the two axes intersect one another within the housing and that they be substantially perpendicular.

The shaft 21 includes a straight section 36 extending along the axis X—X. Section 36 leads to a "dog leg" section 35 which mounts the handle 20 at substantially an obtuse angle "A" to the axis X—X. The obtuse angle "A" included between the axis X—X of the shaft 21 and the central longitudinal axis Y—Y of the handle 20 (FIG. 3) is between 115° and 137° and preferably within the range of 121° and 131°. This angle has been found to be optimum for affecting a natural angular relationship between the wrist and forearm when the device is being operated.

It may be noted that the second handle 20 is intersected along its length by the shaft axis X—X. Such offset is specifically provided for by the "dog leg" section 35 so the shaft axis X—X may be positioned in near alignment with the forearm (as when the device is used as shown in FIG. 1).

The shaft 36 along the length of the shaft means 21 extends through the housing 18. It is secured axially within the housing by spaced snap rings 41 (FIG. 5). The snap rings 41 prevent the shaft from being moved in an axial direction relative to the housing. The snap rings slide relatively freely over the interior surfaces of the housing walls as the second handle 20 is pivoted.

The restrictor means 23 is shown in particular detail in FIGS. 4 and 5 of the drawings. Restrictor means 23 is comprised of a split brake block 43. The block is formed preferably of a synthetic material such as nylon and includes integral brake halves **45*a* and 45*b*. A screw adjustment 46 connects the free ends of the brake halves 45*a* and 45*b* and may be selectively operated to alter clamping pressure of the halves 45*a* and 45*b* against the shaft section 36 engaged thereby. The screw adjustment 46 is comprised of a threaded screw shaft extending through a hole 47 in one of the halves 45*a* (FIG. 4). Another hole 48 is provided in the other half in axial alignment with the first hole. The hole 48 includes a recess 49 for receiving a threaded nut 50. The recess 49 is shaped complementary to a polygonal periphery of the nut 50 to prevent the nut 50 from turning. A shoulder 51 on the shaft adjacent the knob engages a top surface of the half 45*a* to press it toward the half 45*b*** when the screw is tightened.

Opposite the threaded end of the screw 46 is a knob 52. The knob 52 is situated outside and adjacent to the housing to facilitate selective adjustment of the screw and corresponding clamping pressure of the brake block against the shaft 21. The knob and housing are provided with indicia 53 (FIG. 2) that indicate a predetermined amount of frictional resistance offered by the restrictor means to pivotal motion of the shaft means 21.

Prior to using the device, the knob 52 is set to a selected indicia corresponding to a prescribed resistance to rotation of the shaft 21. The screw adjustment 46 is rotated by the turning knob 52, forcing the brake halves **45*a*, 45*b* together or allowing them to spring apart to increase or decrease clamping forces on the shaft 21. When the screw is tightened, the brake block will grip the shaft and resist the turning moment exerted about the shaft axis as the handle 20 is grasped and turned. When it is loosened, the halves will spring apart and release clamping action against the shaft 21**.

Figure 6:
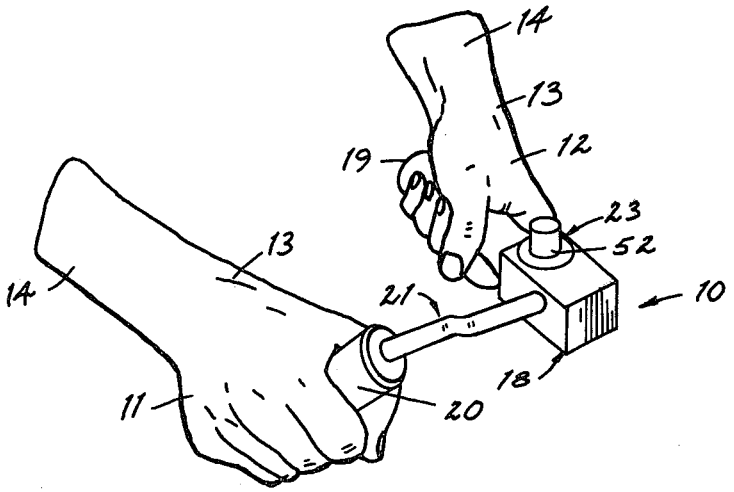
FIG. 6 is an operational view showing a variation in grip for exercising wrist flexor and extensor muscles.
Figure 7:
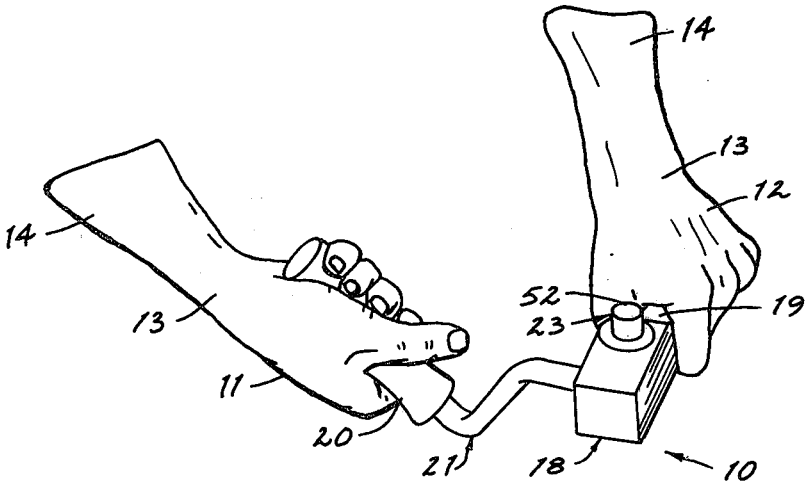
FIG. 7 is an operational view showing a variation in grip for exercising the wrist abductor and adductor muscles.

FIGS. 1, 6 and 7 illustrate three separate hand postures the present device can be held to effectively increase the strength, endurance and control of as many different wrist motions. Before describing the several postures in detail, however, it should be noted that the device can be held and operated by either hand. The drawings all show the first handle 19 in the left hand 12 while the right hand 11 grasps the second handle 20. The grip postures can be reversed simply by rotating the first handle 180° about the shaft axis. The handle 19 will then be located in proper relation to the second handle 20 for gripping by the right hand.

The posture shown in FIG. 1 is preferred for strengthening the muscles involved in pronation and supination (rotation) of the forearm and wrist. The muscles involved in this activity best respond when the wrist is slightly abducted. The angle of the second handle relative to the shaft axis closely corresponds to this desired wrist angle. Thus, the muscles are strengthened to perform best at the position where they produce the greatest amount of force.

Exercise involved with the posture indicated in FIG. 1 is initiated by first grasping the first handle 19 and holding the device at arm's length from the body. The remaining hand grips the second handle at approximately waist height. The handle can then be turned in response to pronation and supination of the wrist. The wrist, in supination, will turn upwardly, with the palm facing substantially upward. Pronation is the opposite move, wherein the hand is turned so the palm faces substantially downwardly.

FIG. 6 shows the desired posture for properly exercising the muscles involved in abduction and adduction of the wrist. The first handle 19 is grasped and held in such a way that it points toward the user's abdomen. The second handle section 36 is substantially horizontal. The wrist must be partially flexed toward the first handle 19 in order to grasp handle 20. The resulting wrist, forearm angle closely approximates the natural angle of the wrist that is assumed for maximum power in adduction and abduction of the wrist.

This exercise is excellent for proper conditioning for muscles used in, for example, pitching a baseball. The exercise is also beneficial for training the wrist muscles for racquet sports.

FIG. 7 shows the desired posture for properly exercising the muscles involved in extension and flexion of the wrist. The first handle 19 is held much in the same manner as it is held in the posture shown in FIG. 1. However, the device is held closer to the user's body. The shaft 21 is inverted from the position shown in FIGS. 1 and 3 so the second handle 20 points up and toward the user's abdomen. The second handle is then pivoted back and forth by flexing and extending the wrist.

This exercise develops muscles used in racquet sports but is particularly useful for golfers who have difficulty with one wrist overpowering the other during a swing. Development of the flexor and extensor muscles of the forearm and wrist result in longer and straighter drives from the tee. Experiments have shown that golfers training with the present device can increase driving distance by twenty to thirty yards and with increased accuracy.

It is noted that the above descriptions are given by way of example to indicate a preferred physical arrangement of the component parts for the present device and for describing several postures in which the device can be used. It is well understood that various modifications of the device may be contemplated and that it may well be used in exercise postures that are not disclosed herein. For example, it is conceivable that for some exercise postures, that the second handle be held stationary while the first handle is pivoted about the axis of the shaft 21. Or, both handles could conceivably be pivoted relative to one another. The pivotable motion, therefore, is relative between the two handles and interconnected housing and restrictor means. The postures capable of being assumed are numerous.

We claim:

1. A hand held device for exercising the muscles of the human arms and wrists, comprising:

a housing;

a first handle stationary on the housing, extending outwardly therefrom along a first axis, adapted to be grasped and held secure along with the housing by a user's hand with the first axis being transverse to the forearm thereof;

shaft means mounted to the housing for rotation thereon about a second axis oriented transversely in relation to the first axis;

a second handle mounted to the shaft means at an angular orientation to the second axis, to be grasped by the user's other hand so the forearm thereof is substantially aligned with the second axis and adapted to be turned about the second axis in one direction by the muscles associated with one wrist motion and in an opposite direction by the muscles associated with an opposite wrist motion; said second handle being mounted at an obtuse angle to the shaft means and wherein the second axis intersects the second handle between the ends thereof; and adjustable restrictor means on the housing and engaging the shaft means for selectively resisting rotational motion of the shaft about the second axis relative to the first handle in response to movement of the second handle by the hand grasping the second handle.

2. The device as claimed by claim 1 wherein the second hanble is mounted at an obtuse angle of between 115° and 137° with respect to the second axis.

3. The device as claimed by claim 1 wherein the second handle is mounted at an obtuse angle of between 121° and 131° with respect to the second axis.

4. The device as claimed by claim 1 wherein the first and second axes intersect one another and are substantially perpendicular.

5. The device as claimed by claim 1 wherein the adjustable restrictor means is comprised of:

a split brake block mounted to the housing and journalling the shaft means between two independently movable brake halves; and a screw adjustment threadably engaging at least one of the brake halves and operatively engaging the remaining brake half so that rotation of the screw will result in movement of the threadably engaged brake half toward or away from the remaining brake half, thereby variably gripping the shaft to offer selected resistance to rotation of the shaft about the second axis.

6. The device as claimed by claim 5, wherein the adjustable restrictor further includes an adjustment knob on the screw; and indicia on the housing and knob for indicating values of resistance to rotation of the shaft.

7. The device as claimed by claim 1 wherein the second handle is mounted at an obtuse angle of between 115° and 137° with respect to the second axis.

8. The device as claimed by claim 1 wherein the second handle is mounted at an obtuse angle of between 121° and 131° with respect to the second axis.

* * * * *